US005438720A

United States Patent [19]

Daneshvar

[11] Patent Number: 5,438,720

[45] Date of Patent: Aug. 8, 1995

[54] TOE PROTECTOR AND RELATED DEVICES

[76] Inventor: Yousef Daneshvar, 33200 Slocum, Farmington, Mass. 41024

[21] Appl. No.: 945,618

[22] Filed: Sep. 16, 1992

[51] Int. Cl.[6] ..... A47C 21/02

[52] U.S. Cl. ..... 5/505.1; 5/648; 5/424

[58] Field of Search ..... 5/505.1, 504.1, 424, 5/648, 651

[56] References Cited

U.S. PATENT DOCUMENTS

| | | | |
|---|---|---|---|
| 1,268,327 | 6/1918 | Conrad | 5/505.1 |
| 2,209,801 | 7/1940 | Valverde | 5/505.1 |
| 2,356,219 | 8/1944 | Coffing | 5/505.1 |
| 2,595,449 | 5/1952 | Coffing et al. | 5/505.1 |
| 2,607,933 | 8/1952 | Fulton | 5/505.1 |
| 2,611,139 | 9/1952 | Ecklund | 5/505.1 |
| 2,646,578 | 7/1953 | Evans | 5/505.1 X |
| 2,674,750 | 9/1954 | Moore | 5/505.1 |
| 2,722,692 | 11/1955 | Dempster | 5/648 X |
| 2,750,604 | 6/1956 | Gold | 5/505.1 |
| 3,317,932 | 5/1967 | Gibbons, Sr. | 5/505.1 |
| 3,680,158 | 8/1972 | Speed | 5/505.1 |
| 3,713,182 | 1/1973 | McNeal | 5/505.1 X |
| 3,808,614 | 5/1974 | Reinhard | 5/505.1 |
| 4,975,997 | 12/1990 | Misiura et al. | 5/505.1 |
| 5,175,899 | 1/1993 | Lou | 5/505.1 |

FOREIGN PATENT DOCUMENTS

| | | | |
|---|---|---|---|
| 195201 | 2/1908 | Germany | 5/505.1 |

*Primary Examiner*—Michael F. Trettel

[57] ABSTRACT

Disclosed are various embodiments of devices for placement at the foot end of a bed for supporting a blanket above a person's toes. The devices are collapsible when not used and can be moved out of the way to change the mattress sheet. Various accessories for the devices are also disclosed, including a heater and a cradle for elevating the feet. The cradle can be motorized and the heater controlled by a controller and a thermostat. A full leg support for supporting the full length of an elevated leg is also disclosed.

33 Claims, 15 Drawing Sheets

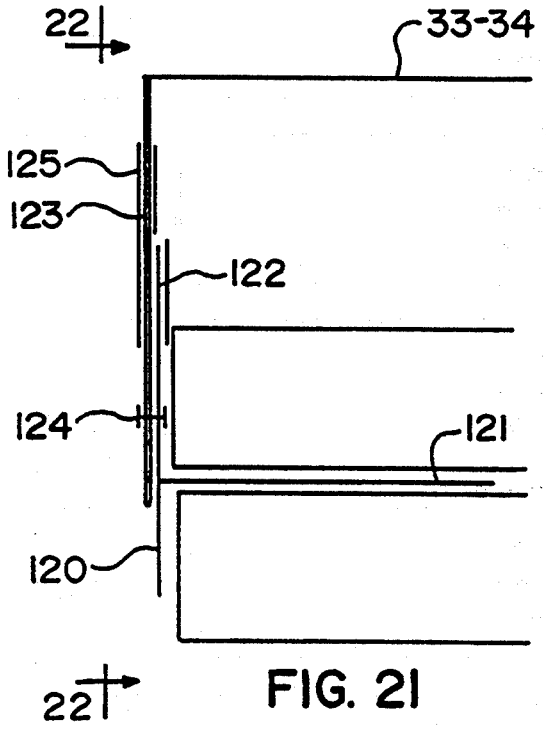
FIG. 21
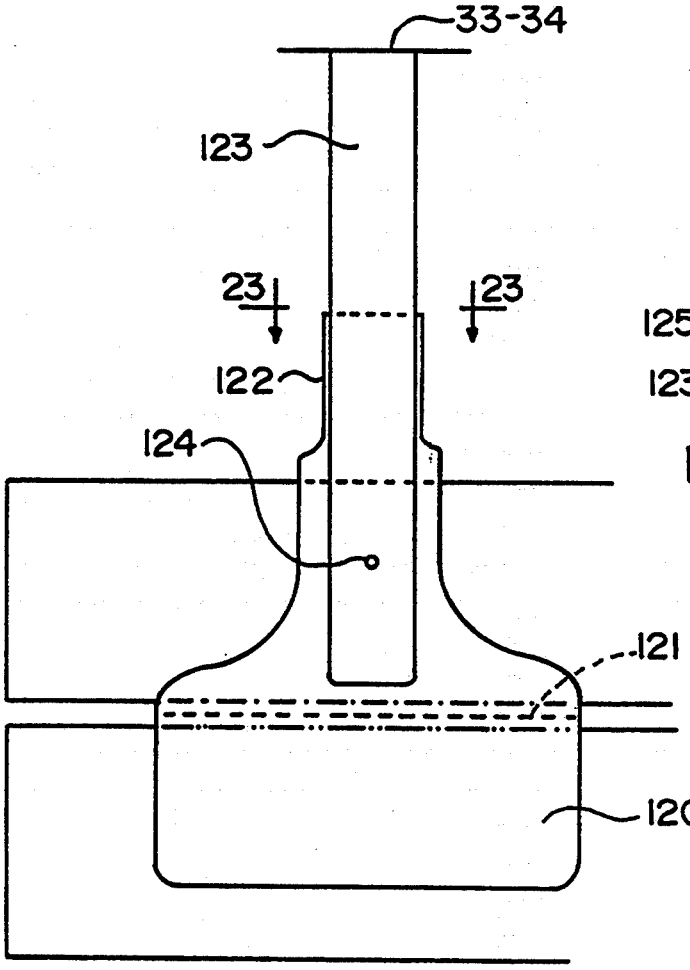
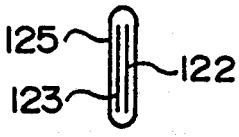
FIG. 23
FIG. 22

TOE PROTECTOR AND RELATED DEVICES

BACKGROUND OF THE INVENTION

This invention is made after my observations of pain and discomfort which are caused by pressure to the big toes that occurs due to the weight of blankets, sheets, and bed covers.

It is known that age brings a significant anatomical change to the toes, and in my practice as a doctor I have seen many such deformities of the toes in my patients. It is also a well known fact that pressure causes change and deformity, and I believe that in normal big toes, and especially in deformed big toes, the pressure and weight of blankets and covers will cause more discomfort, pain, and possibly more deformity of the big toes. This led me to conceive this invention.

I have also heard many of my patients complain about cold feet, and I made my device for making the space around the feet to be warm, for those people to enjoy it, as well as some patients with some foot and toe problems needing a warm, dry place for their feet. I also have made a system in which persons can hold their feet up in a cradle, or they can move the feet up and down with use of an electric controller. This part will be very useful in people who have phlebitis, swelling of the legs, or leg ulcers, when the physician orders the leg to be elevated, as well as those people who simply like to have their feet elevated for sometime to have the swelling feel better. This invention can provide all of these things together.

BRIEF SUMMARY OF THE INVENTION

This invention is based on a very useful device. A piece made from metal or hard plastic that will stand in the lower part of the bed to hold the blanket above the bed and to prevent pressure of the blanket and the cover on the toes. This will stand by a base that will be seated on the mattress and/or in between the two mattresses people use. Or it can even be used under one mattress with some modification. This part can be rotated and lowered to stay on the bed when not needed, which gives a big advantage to allow the bed to be normal during daytime and people to be able to sit on the edge. The height of this unit can be adjusted in some models. A heater is also included in this unit to make the space under the blanket warm to let the person enjoy it. A controller as well as a thermostat will allow the temperature of that space to be kept in the desired level automatically. Since the height of men and women are different, and they may sleep on different sides of the bed, a small flap is made that can be turned to one side or another to allow the adjustment of the point where the blanket is desired to be kept elevated. A technique is also incorporated to hold the legs elevated on a cradle, and this can be reversibly done by the use of an electrical engine. A long cradle will allow the whole leg to be kept elevated on it for a long time and its level to be changed.

BRIEF DESCRIPTION OF THE DRAWINGS

FIG. 2O*a* is a side elevational view of a fifth embodiment.

FIG. 21 is a side elevational view, partly in cross section, of a sixth embodiment on a bed.

FIG. 22 is a partial side elevation view in the direction of arrows 22—22 in FIG. 21.

FIG. 23 is a cross sectional view in the direction of arrows 23—23 in FIG. 22.

DETAILED DESCRIPTION OF FIGURES

Figure 3:
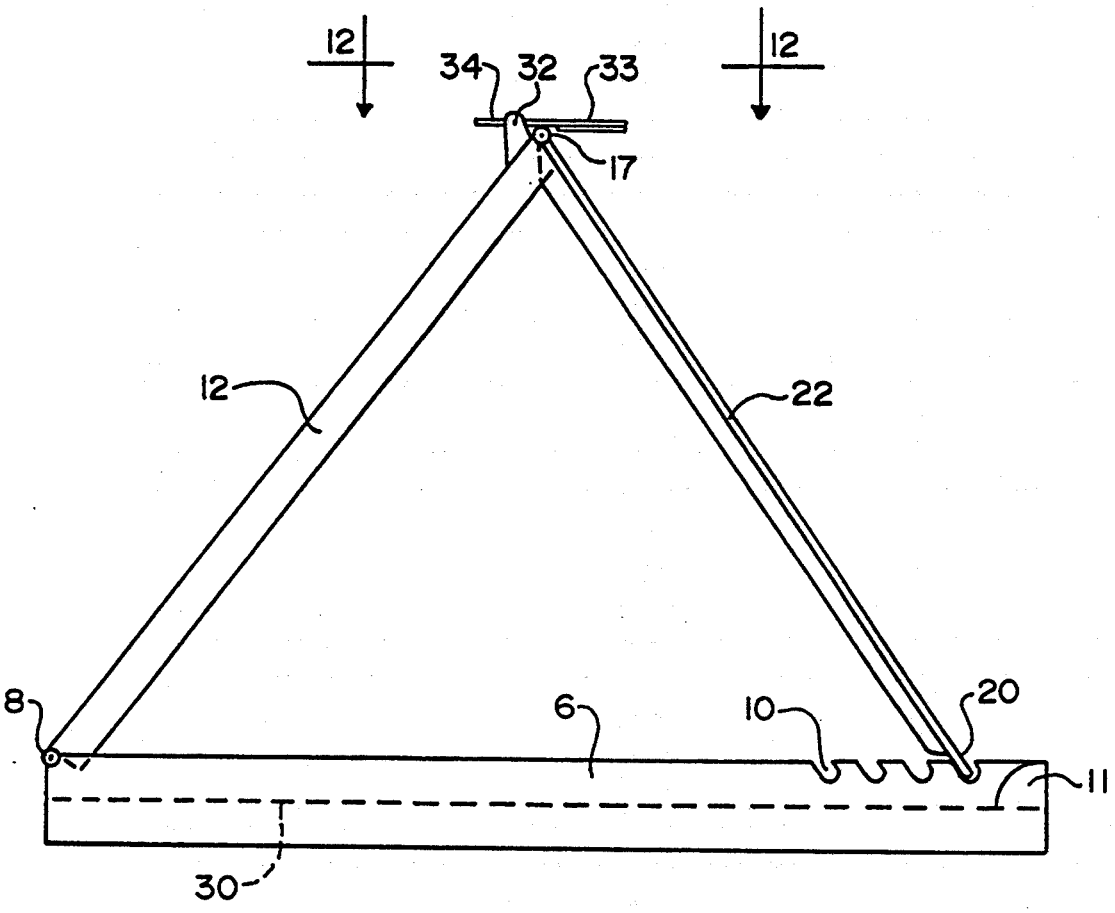
FIG. 3 is a view of the first embodiment in the same direction as that of FIG. 2, but showing the toe protector on a larger scale by itself.
Figure 3A:
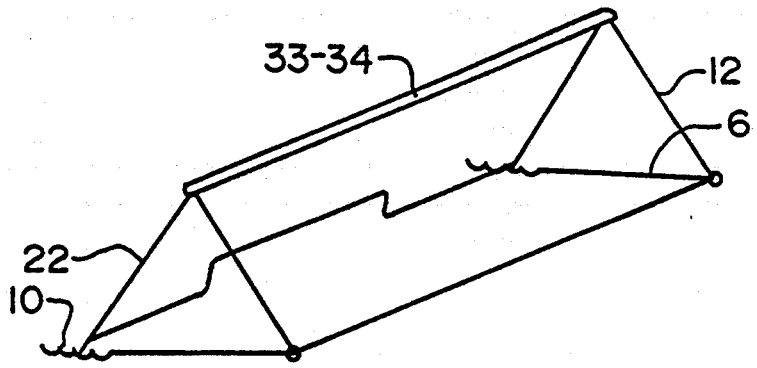
FIG. 3*a* is a perspective diagrammatic view of the first embodiment by itself.

FIG. 3*a* shows a unit made in the shape of the edges of a long triangular prism, the height of the prism equal to the width of a bed. The sides of this prism are empty and not covered. This unit is positioned on the foot end of the mattress on one of the prism's sides, and the end triangles face the sides of the bed. One side of the prism sits on the bed when the opposite angle is in the air and to be connected to a piece 33-34 to hold it secure enough for holding the blanket on its top.

Figure 20C:
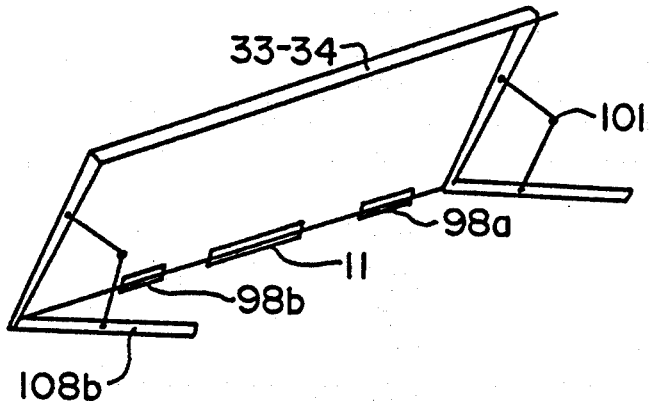
FIG. 20*c* is a perspective diagrammatic view of the fourth embodiment by itself in a partially collapsed condition.

FIG. 20*c* shows a unit primarily made from two large horseshoe-shaped metals that are hinged to each other in their long mid portion by hinges 98*a*, 98*b*. These hinges allow the connected pieces to be rotated easily. The lower part is fixed to stay on the lower end of the mattress. Then the upper part is rotated to stay up by use of different levers, so as to be sturdy enough to hold the blanket on top of the flat piece 33-34.

Figure 24A:
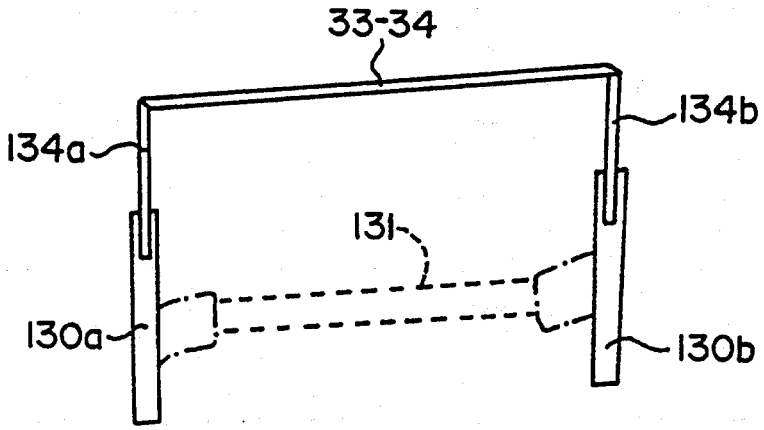
FIG. 24*a* is a perspective diagrammatic view of the seventh embodiment.

FIG. 24*a* shows how the piece 33-34 is kept up in the air with the help of two poles 134*a*, 134*b*. These poles can be pressed to go inside their parking parts 130*a*, 130*b* when they do not need to be in the top position.

Figure 22D:
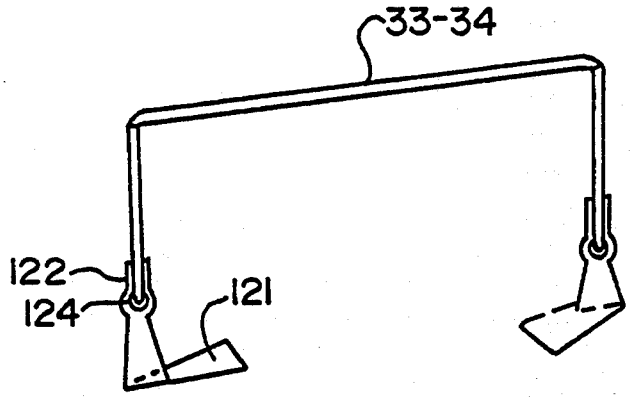
FIG. 22*d* is a diagrammatic perspective view of the sixth embodiment.

FIG. 22*a* shows the piece 33-34 can be kept elevated in the air by use of a U-shape metal piece whose two free ends are hinged to a base that is kept sturdy on the lower end of the bed with the use of parts that will be explained later.

Figure 26A:
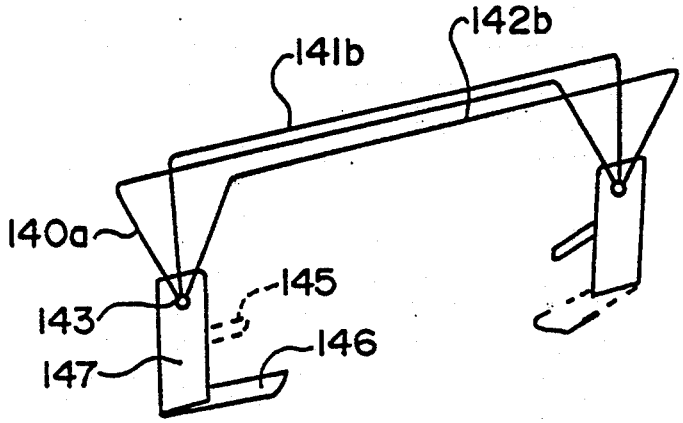
FIG. 26*a* is a diagrammatic perspective view of the eighth embodiment.

FIG. 26*a* is a unit similar to the one shown in FIG. 22*a* except the U-shaped metal parts are more than one, and they are held by being parked in their hinged area. More details will be explained later.

Figure 34:
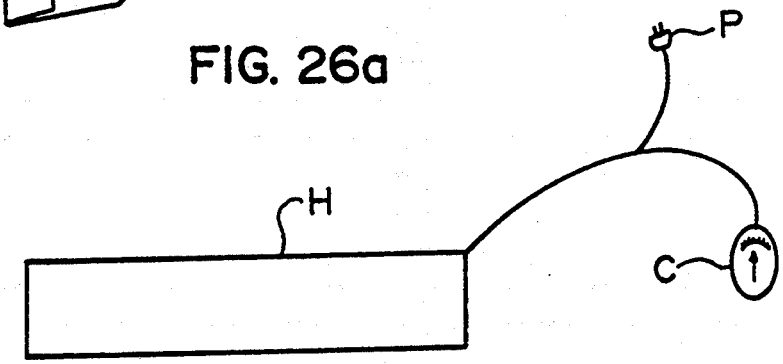
FIG. 34 is a plan view of another accessory.

FIG. 34 is the general look of a heater H that will lay on the lower end of the bed to keep the feet warm, a controller C is connected to the wire which has the plug P. With these general ideas mentioned, then I will proceed to explain the figures.

Figure 1:
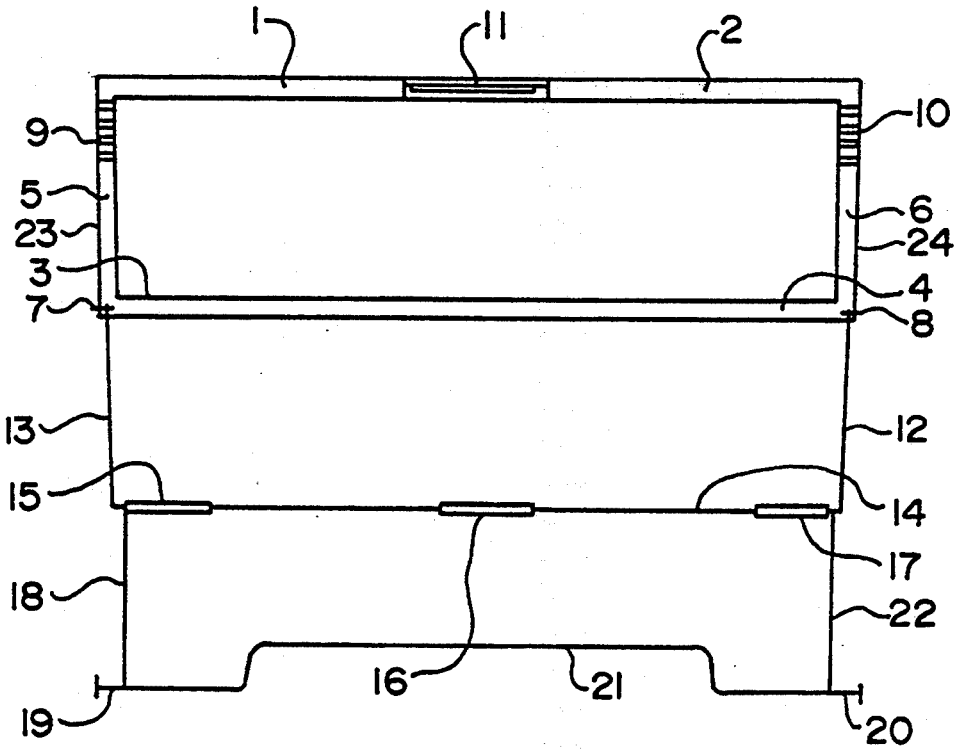
FIG. 1 is a top plan view of a first embodiment of toe protector embodying principles of the invention shown in a flat condition for illustrative purposes.

FIG. 1 shows a unit made with three almost rectangular parts that are hinged together, so that they can be rotated to make the shape shown in FIG. 3*a*. The base part, shown at the top, has the shape of a rectangle. The front side of this rectangle is shown by 1, 2, and has a place for a heater 11. The back side of this rectangle is shown by 3, 4, the left end side by 3 and the right end side by 4. The left side of this rectangle is shown by 5 and the right side by 6. The other piece (I call here as part a) has a shape like three sides of a rectangle; one long end shown by 14 and two smaller sides shown by 13 (the left side) and 12 (the right side). The end of side 13 is hinged to the base part in place shown by 7, and the end of side 12 is hinged to the base in place shown by 8 so that part a can rotate around these two hinges, and since it has a smaller size than the base, it can be fitted inside the base.

Figure 2:
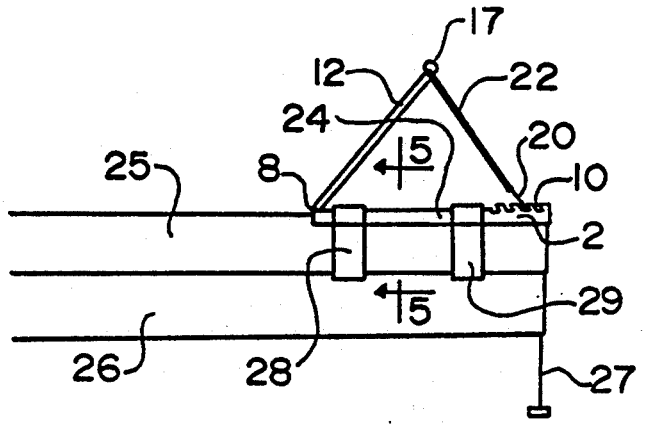
FIG. 2 is a right side elevational view of the first embodiment shown in a condition of use on a bed.

The third part (I call here part b) is almost like a rectangle. It has two long arms, one that is hinged to the long side of part a by three hinges 15, 16 and 17 so that it can rotate easily around these hinges. Then another long arm shown by 21, with two bends in its two ends so that it does not touch the heater when this part is in place. This part b has two small sides 18, 22. The extreme ends of piece 21 end with two straight metal pieces 19, 20. FIG. 2 will help to understand the function of these parts.

FIG. 2 illustrates the unit shown in FIG. 1 in functional state sitting on the lower end of a mattress 25. Basically this figure shows the lower part of a regular bed, the upper mattress by 25 and the lower mattress by 26. The lower mattress is standing on a pole 27. The base piece of the toe protector is on the top of the lower end of the upper mattress. This part is held in place by two bands 28 and 29. The right side of the base is shown by 24. Here the part a is turned around the hinge 8 to make an angle of about 60 degrees with the base part of the toe protector. The part b is also turned around the hinge 17 and makes an angle with part a. The end of side 22 shown in FIG. 1 by 20 is sitting inside an indentation 10 of the right side of the base. This combination has made a shape like a triangle whose base is on the mattress and whose top is in the air. Part 14 allows the blanket to sit on its top. Ideally this should be positioned so that the toes of the feet will stay under 17 and heater 11 will make the area warm.

FIG. 3 is an enlarged view of FIG. 2 to illustrate details. This is a right side view of the toe protector when it is in place on the mattress. In this view the dotted line 30 shows the flat part of the right side of the base of the toe protector that fits and sits on the right side of the mattress. 6 points to a slightly raised vertical rim of the base that will stay above the mattress level, and to end with oblique cuts 10. These cuts will accept the end 20 of the part b allowing it to sit inside the cuts, in order to make the part b securely placed in it. This structure makes a sturdy structure to keep hinge 17 and its related parts held strong on the top of the end of the bed for the blanket to sit on them. 11 is the side view of the place for the heater. 12 is the side view of the right side of the part a, whose lower end is hinged to the rear end of the right side of the base by hinge 8. The upper end of part a is connected to the end of part b by hinge 17. In the back part of the upper end of part a there is a small piece 31 that allows a flat part 33, 34 to be hinged to it at 32, so that piece 33-34 can swing around hinge 32 to stand flat and strong with its lower part sitting on the top of the hinge 17. The blanket will stay on the piece 33-34.

The part b is shown by 22 and it is connected to the upper end of part a by hinge 17. The lower end of 20 sits inside indentations 10 on the right side of the base. Again these combinations make a side shape like a triangle, that allows the blanket to sit on the top piece 33-34 and on top of hinge 17. The freedom of end 20 to sit in different cuts 10 allows the height of this triangle to be changed and to give some versatility for the height.

Figure 4:
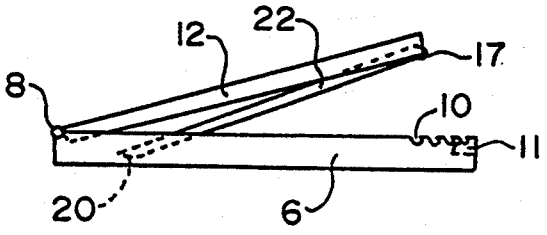
FIG. 4 is a view in the same direction as that of FIG. 3, but showing the toe protector on a reduced scale and in an almost fully collapsed condition.

FIG. 4 is similar to FIG. 3 and is to illustrate how the pieces of this model of toe protector can be rotated to fit inside the base in order to allow it to be stored under the bed or similar areas when needed. This Fig. shows the rotation of part b around hinge 17 to allow it to fit inside part a, and part a to rotate and to fit inside the base.

Figure 5:
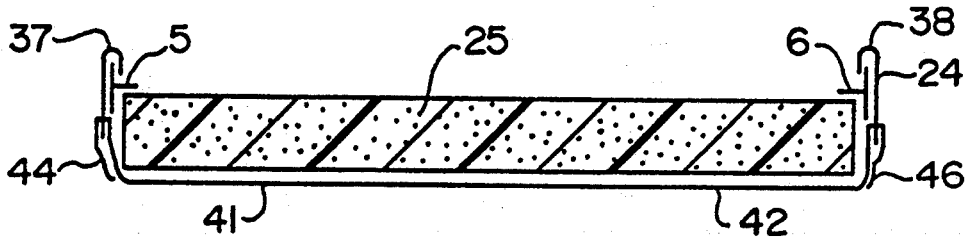
FIG. 5 is a cross sectional view in the direction of arrows 5—5 in FIG. 2.

FIG. 5 illustrates how the base of the toe protector can be mounted and kept in place on the mattress. In this view 25 is the cross cut of the mattress and 5, 6 show the left and right sides of the base sitting on the edge of the mattress. 24 shows the vertical rim of the side of the base. 37, 38 show left and right hooks that hang on the vertical side of the base, and their lower ends allow ends of straps 41, 42 to go through openings in the lower ends of the hooks, then to come and be attached to the back of their own side by use of Velcro TM shown by 44, 46. This structure will pull the hooks down to make the base tight in position on the mattress.

Figure 6:
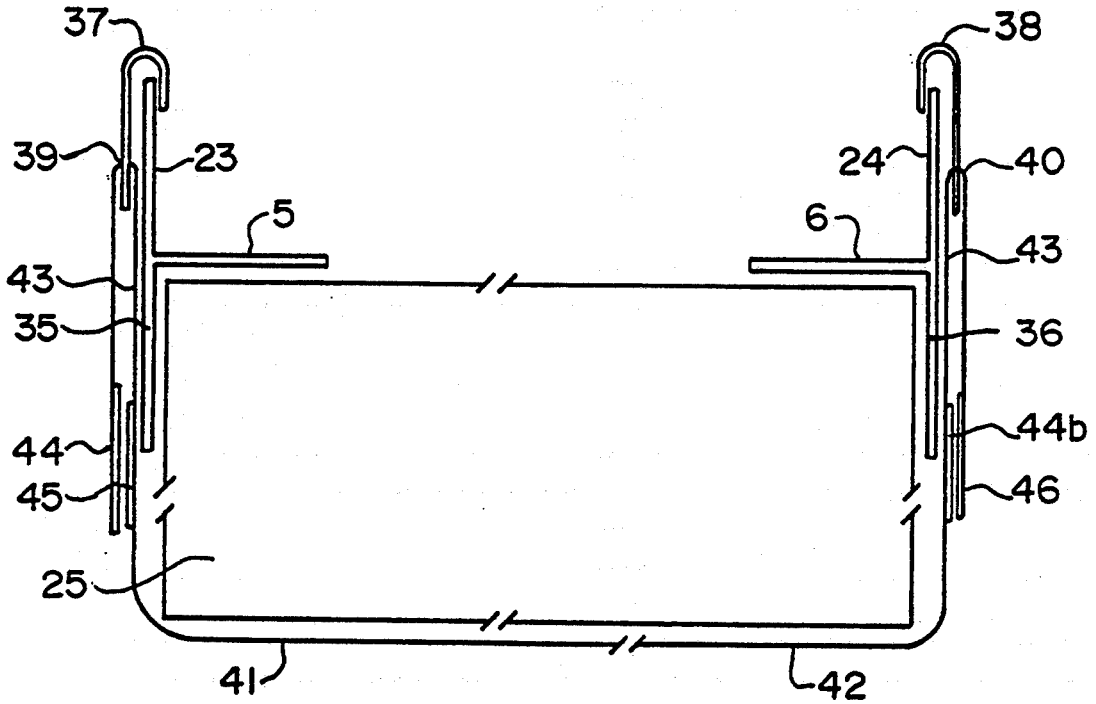
FIG. 6 is an enlargement of FIG. 5 for showing more detail, with portions broken away.

FIG. 6 is basically an enlarged view of FIG. 5 to illustrate how the base can be mounted and kept sturdy in place on the mattress. In order to show the important parts, the width and the height of the mattress as well as the length of straps 41, 42 are cut. 5, 6 point to the left and right side of the flat part of the sides of the base. 23, 24 point to the upper vertical rim of the side of the base. 35, 36 point to the lower vertical rims of the base which fit and stand at the side of the mattress. 37, 38 point to the upper end of the left and right hooks that are hanging on the vertical rim of the side of the base. From the other side the ends of straps 41, 42 go through the openings in the lower ends of the hooks to make a U-turn and to come and be attached in the back of strap with use of Velcro TM patches; at the left side 44 attaches to 45 and at the right side 44*b* attaches to 46. The elasticity as well as toughness of straps 41, 42 will pull the hooks down to make the base tight and to keep it in position on the mattress. When we consider the whole shape of the base, it will then be clear that this should be enough for the whole unit to be properly located and be secured too.

Figure 7:
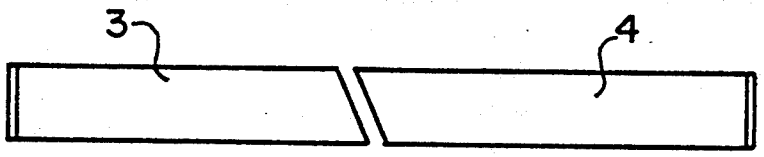
FIG. 7 is an enlargement of a portion of FIG. 1 shown by itself.

FIG. 7 shows the top view of the rear side of the base of the toe protector. This shows the flat part of this piece in the center; 3 is the left side, and 4 is the right side. The broken away part in the center is to allow me to show the ends of this unit. The ends of this piece are joined to the vertical rim at 23, 24 and these make a place for the lower end of part a to be hinged to it at 8.

Figure 8:
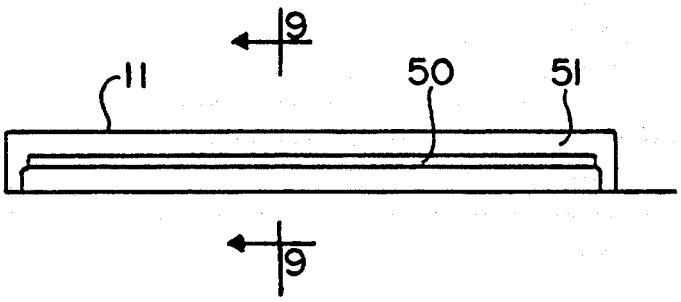
FIG. 8 is an enlargement of another portion of FIG. 1 by itself.

FIG. 8 shows the heater that has a flat long space with a long element 50 inside it. 11 points to the outer cover of the heater, and 51 is a reflector that is made from a shiny surfaced metal to reflect the heat waves like a mirror.

Figure 9:
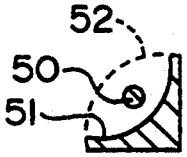
FIG. 9 is a transverse cross sectional view in the direction of arrows 9—9 in FIG. 8.

FIG. 9 shows a protector screen 52 to prevent a person from touching the element as well as objects hitting and breaking the heater.

Figure 10:
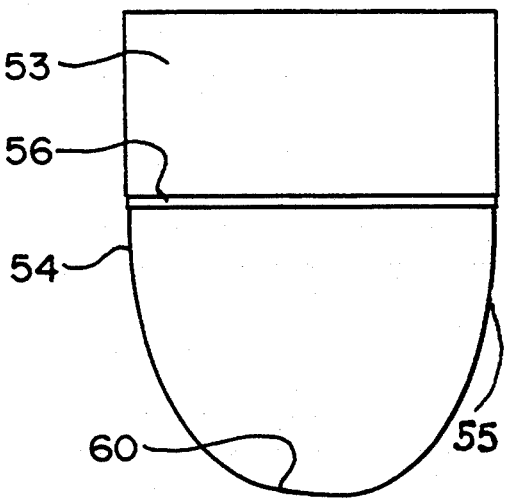
FIG. 10 is an end view of an accessory for the first embodiment.

FIG. 10 shows the front view of a piece that holds the legs above the bed. A plastic or metallic box 53 at the top is to hold the blanket higher so the toes will not hit the blanket when raised by a cradle 60. The cradle is suspended from the sides of the box. 56 is a spring that will help the box to stand on top of the flat upper part 33, 34 of the toe protector. 54, 55 are straps or thin ropes that will hold the cradle in place.

Figure 11:
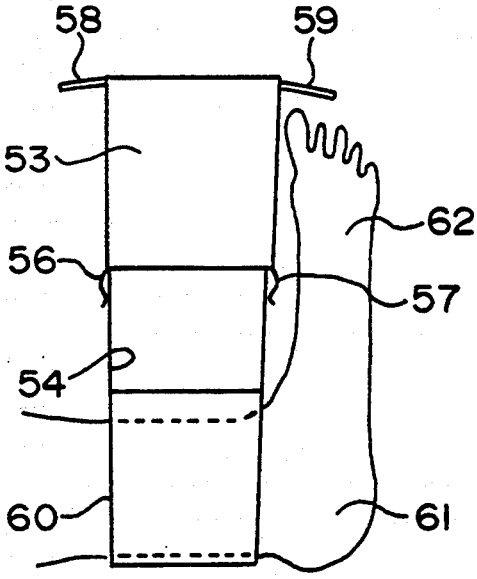
FIG. 11 is a right side elevational view of the accessory of FIG. 10 showing use.

FIG. 11 shows two pieces 58, 59 that are extensions from the top of box 53 to hold the blanket from the toes balanced. 56 and 57 are the springs that will fit the sides of the top of the toe protector, as mentioned above. 61 is a human heel and 62 the front of the foot.

Figure 12:
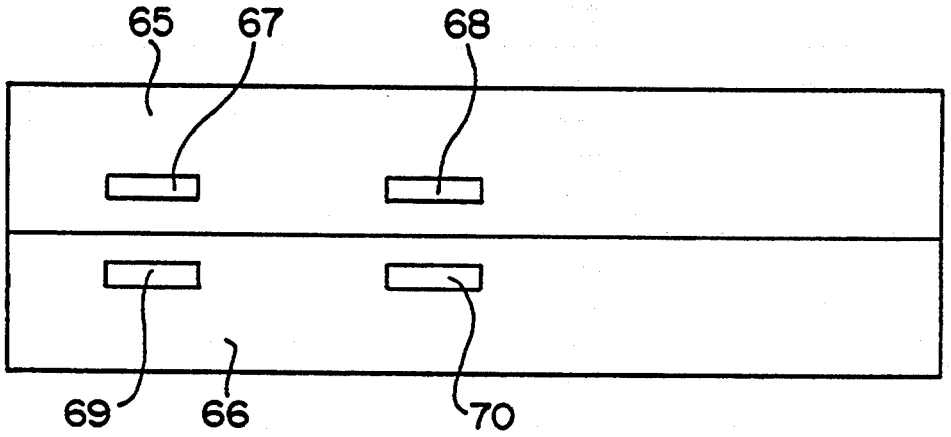
FIG. 12 is an enlarged view in the direction of arrows 12—12 in FIG. 3 to show additional detail.

FIG. 12 shows more detail of the part 33-34 shown in FIG. 3 and other figures. When this piece is in place, 65 is toward the foot end of the bed and 66 is toward the head end of the bed. The openings 67, 68 and 69, 70 are for pieces 67*b*, 68*b* of a flap (shown in FIGS. 13 and 14) to be entered and secured. The following two Figs. will help to understand the job of this part.

Figure 13:
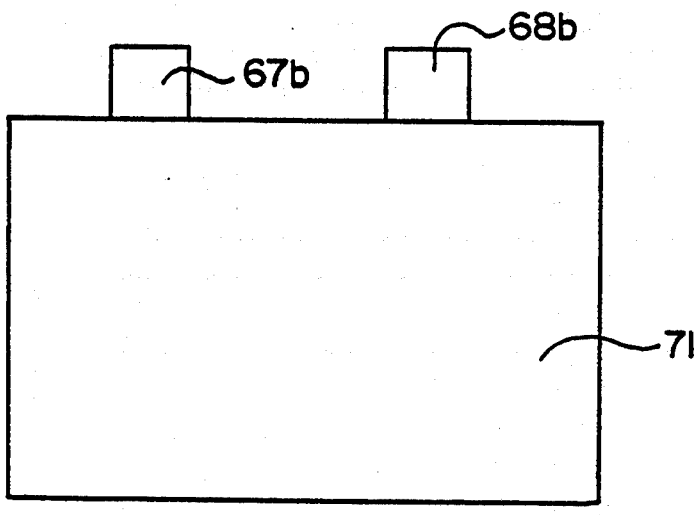
FIG. 13 is a top plan view of another accessory for the first embodiment.

FIG. 13 shows the top view of a flap that is a flat piece of metal that will be secured on top of the part 33-34 to allow the blanket to be held higher for a greater length of the bed. This piece has a flat part 71 and has two small tongues 67*b*, 68*b*. When in place, tongue 67*b* will fit opening 67, tongue 68*b* will fit opening 68, and the body 71 of this piece will sit on the area 66 of the piece of FIG. 12.

Figure 14:
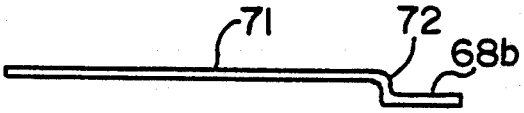
FIG. 14 is a right side elevational view of FIG. 13.

FIG. 14 shows a bend 72 that the base of the tongue 68*b* has and it will play the key point in holding the flap in place inside opening 68.

In order to change the point where the blanket will be held elevated, two pieces are designed as shown in FIGS. 12, 13 and 14. The flap of FIGS. 13 and 14 can be removably inserted into the top of piece 33-34. This system will allow it to be rotated 180 degrees in different ways, this rotation will make the flap's ends to be either toward the head of the bed or the foot end of the bed. Again this will make it possible to adjust the position of the place where the person wants the blanket to be held elevated. The reason I have decided to include this part is that, in general, men are taller than women and the chance that a couple may have different heights is very high. Therefore ideally they should have the option of having their blanket held up in different places, which this flap will do this job most of the time when the difference in height is not very significant.

Figure 15:
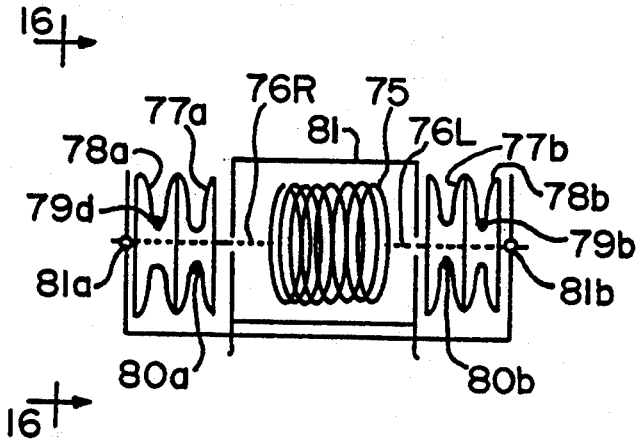
FIG. 15 is a plan view of a further accessory for the first embodiment.

FIG. 15 shows a mechanism to lift the cradle. It has a small electrical engine 75 in the center that will rotate shafts, one 76R to the right and one 76L to the left. These shafts will go through two flat spools for each side, 77*a*, 78*a* for the one side, and 77*b*, 78*b* for the other side. The ends of the shafts will be in holes 81*a* in one side and 81*b* in the other side to make the shaft to be secure and in place. The spools will have matching hooks 79*a*, 79*b* for each side and 80*a*, 80*b* in the other in order to have ends of ropes 84*a* and 84*b* (only the front pair are shown here) to be hooked to them so that when the engine runs, the spools will turn and the ropes will be pulled to elevate the cradle.

Figure 16:
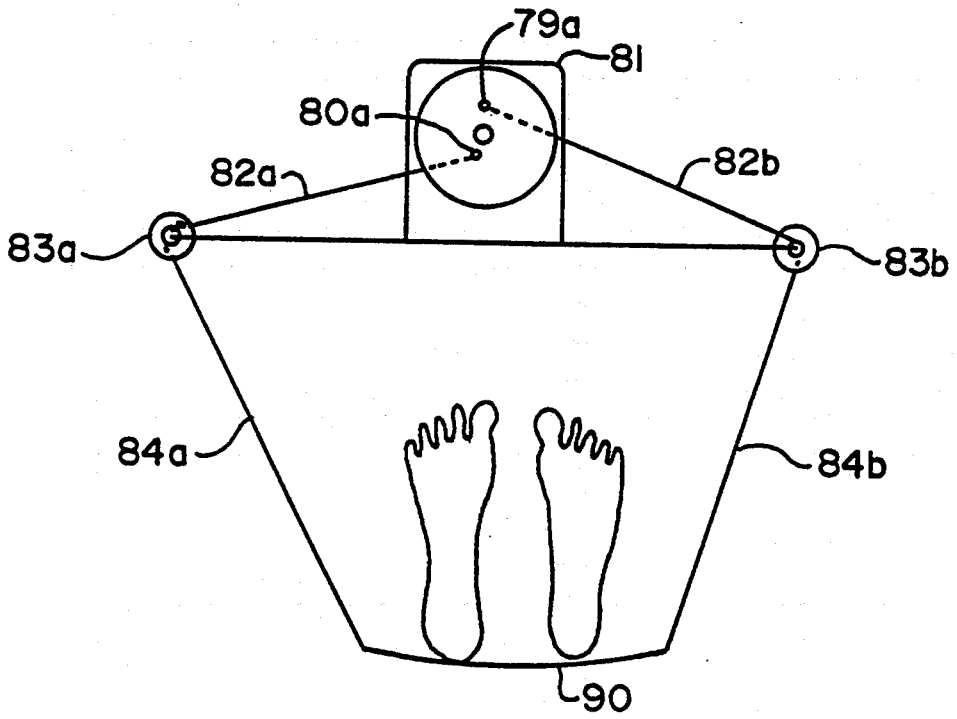
FIG. 16 is a view in the direction of arrows 16—16 in FIG. 15, showing usage.

FIG. 16 shows the foot elevator when it is mounted on the top of the toe holder and viewed from the end of the bed. Here we see the soles of the person who is using this unit. Engine 75 is mounted on piece 33-34. There are two small wheels 83*a*, 83*b* that are designed to have the ropes go over them in order to minimize the friction of the motion of the ropes 84*a*, 84*b* as well as giving them distinct and steady directions. The ropes come to be fixed on points 79*a*, 80*a*. A cradle 90 that has a soft surface will have the feet on its upper surface. With motion of engine 75, the spools will rotate and pull the ropes and move the piece 90 smoothly up or down. The controller will be either alone or joined to the controller of the heater.

Figure 17:
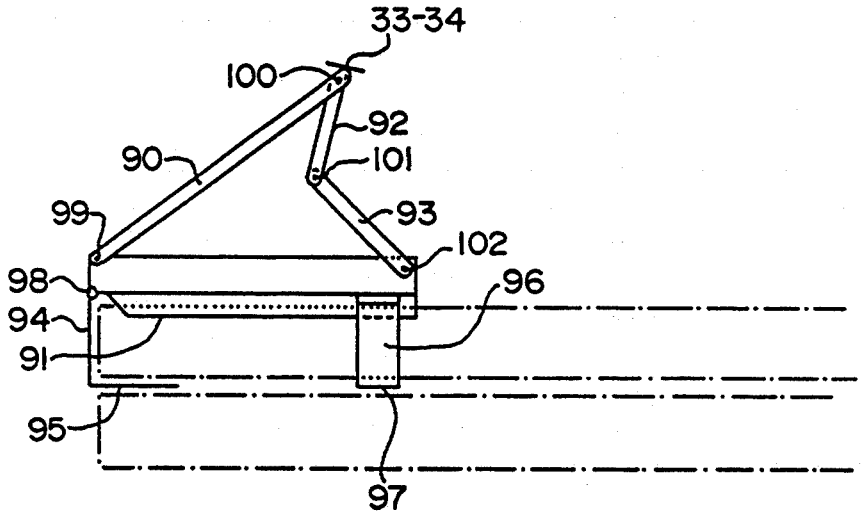
FIG. 17 is a left side elevational view of a second embodiment on a bed.

FIG. 17 shows the base of the toe protector having a side 91 that is held in place by a vertical piece 94 that stays in the lower end of the bed with its horizontal piece 95 going in between the two mattresses. The other end of the base of the toe protector (the side close to head of the bed) is held by a strap 97 that goes under the upper mattress all the way to connect to the other side of a hook that joins the end of strap 97. A hinge 98 allows the base of the toe protector and its connected pieces to be rotated all the way out to allow the sheet on the bed to be changed. This can be done after releasing the hook which is connected to 98. The part a is connected to the base with a hinge 99 (optionally, this hinge can be replaced with hinge 98). A hinge 100 connects part a to pieces 92 and 93 that are connected by hinges and this piece will function as a lever when is straighted. This can be done with a simple common method and also with using a sleeve that goes over hinge 101 so that this hinge will be immobilized easily and the total unit will be stable allowing the piece 33-34 to hold the blanket in its top.

Figure 18:
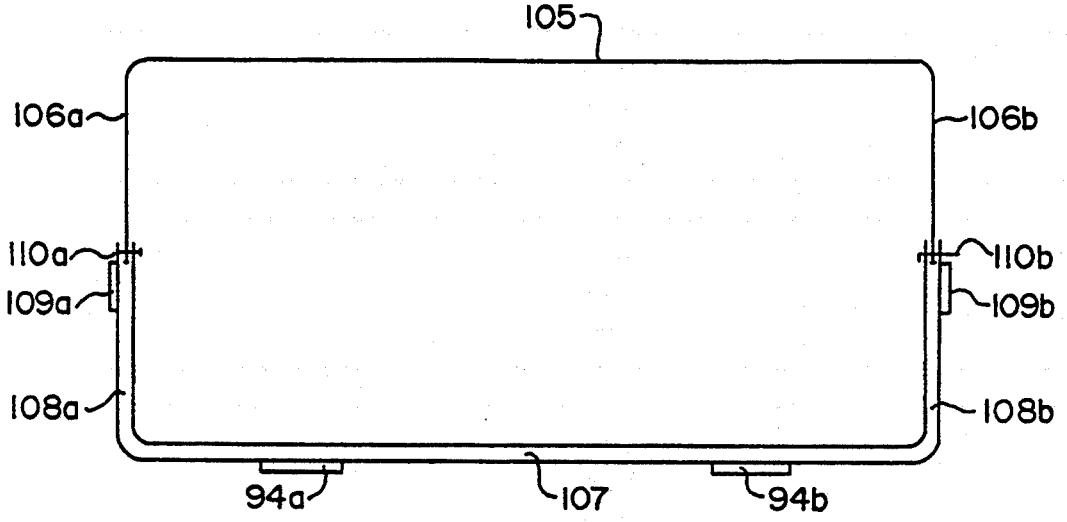
FIG. 18 is a top plan view of a third embodiment in a flat condition for illustrative purposes and incorporating certain features of the first and second embodiments.

FIG. 18 shows a toe protector like FIGS. 1, 3 but with a slightly different construction that eliminated the rear part of the base piece shown at 3, 4 in FIG. 1. Also, fixation of the base on the bed is similar to FIG. 17 with one piece in the very end of the mattress and also with use of hooks at the sides. In this picture the long side of the base piece is shown by 107 and its shorter sides 108*a* and 108*b*. This base is held by pieces 94*a*, 94*b* like 94 in previous figure. Openings 109*a*, 109*b* are places where the ends of hooks (96 from FIG. 17) are connected and sit inside them. The part a (shown by 105, 106*a*, 106*b*) is connected to the base by hinges 110*a*, 110*b*. The part a can be rotated and kept in the air by use of levers to support it in the air such as one similar to part b from FIGS. 1, 2 and 3, or 92, 93 of FIG. 17.

Figure 19:
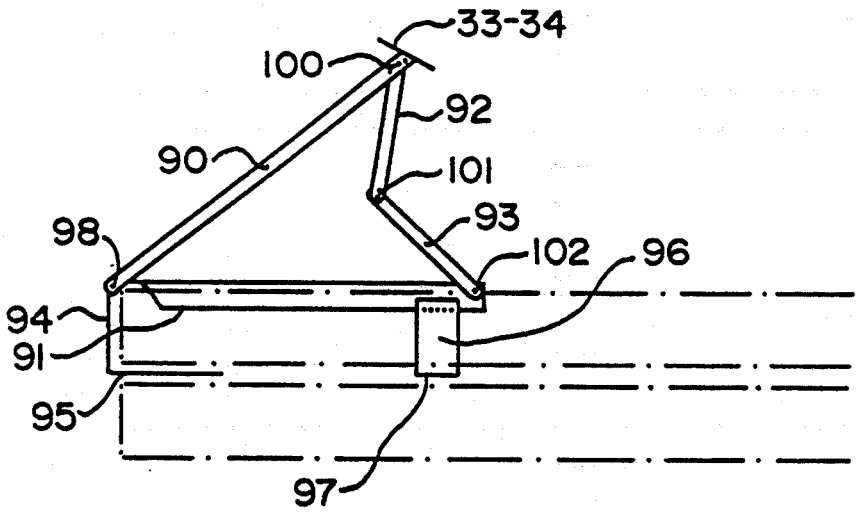
FIG. 19 is a view similar to FIG. 17 to show a fourth embodiment as a modified form of FIG. 17.

FIG. 19 is a toe protector very similar to FIG. 17 except hinge 99 from FIG. 17 is eliminated so that the unit can be simpler and the whole unit can be easily rotated all that way down and away from the bed with use of hinge 98, after the hooks connected to strap 96 and its counterpart are released. The rotation and removal of the unit out of the way will allow the sheets on the mattress to be changed easily.

Figure 20:
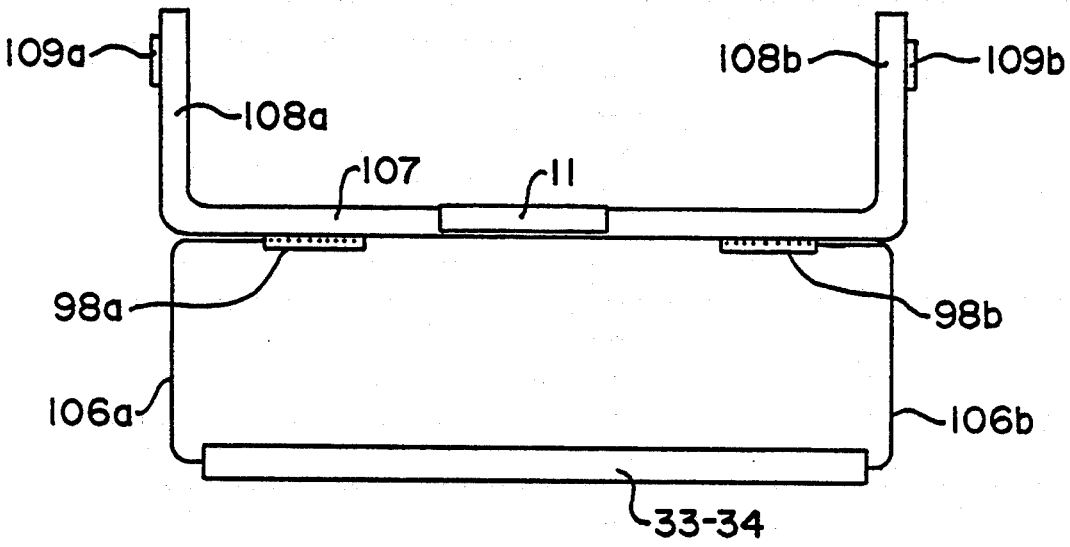
FIG. 20 is a top plan view of the fourth embodiment shown in a flat condition and with certain portions removed for illustrative purposes.

FIG. 20 shows the top view of FIG. 19. Here a base unit 107 is shown with its sides 108*a*, 108*b* and the heater by 11. The openings for the attachment of the hooks are shown by 109*a*, 109*b*. This base is connected to part a by hinges 98*a*, 98*b*. I would like to mention that these hinges are also connected to the pieces 94 and its base 95 from FIG. 19, which are not shown here. (For clarification purpose, please let me mention here that the part a consists of sides 106*a*, 106*b*, and their extensions which connect to hinges 98*a*, 98*b*. The lever that holds part a in place is not shown here but it can be one of the many simple methods mentioned earlier such as part b from FIGS. 1, 2 and 3, or pieces 92, 93 of FIG. 17, or a U-shape lever connected to the base whose opening will accept and hold the sides 106*a* and 106*b* of part a inside itself.

Figure 20A:
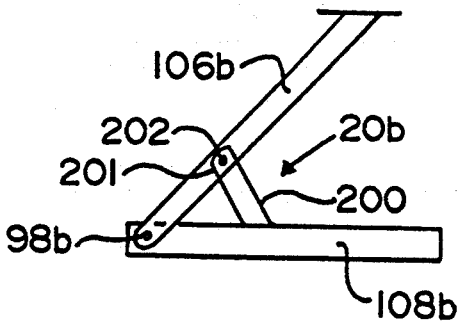
FIG. 20*b* is a view in the direction of arrow 20*b* in FIG. 20*a*.
Figure 20B:
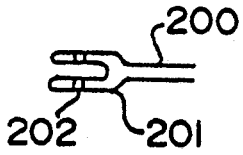

A U-shape lever can also be used to hold the pieces 106*a*, 106*b* in place. This is shown in FIG. 20*a*. The base piece 108*b* is held on the mattress. The piece 106*b* will be held in the air with the use of piece 200 with a U-shape tip 201 having a hole 202, for a nail to go through and hold them securely. FIG. 20*b* shows the top view of this U-shape lever. It is easy to imagine that this kind of lever can be used in many different sizes and shapes for holding two pieces of metals mentioned in devices that I explain in this application.

FIG. 21 has two poles which hold the bar 33-34 and is connected to the base by a simple hinge 124. When the person no longer needs the bar 33-34 to be up on the bed, he can rotate the bar about 90 degrees or so to lay in on the foot end of the bed. The base 120-122 will be held in place with a flat piece 121 that goes into the space between the two mattresses. When the pole 123 is up, a sleeve 125 will fit over pieces 122 and 123 to hold them together tight and prevent the bar from falling down.

FIG. 22 shows the toe protector of FIG. 21 functionally in place. In order to avoid confusion in this view the sleeve 125 is not shown. FIG. 23 shows base part 122 and upper pole 123 when they are standing next to each other and are held in place by sleeve 125 around them.

Figure 23A:
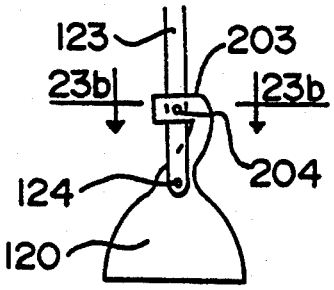
FIG. 23*a* is a modified form of FIG. 21.
Figure 23B:
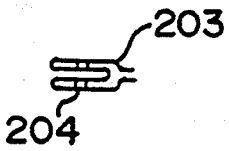
FIG. 23*b* is a view in the direction of arrows 23*b*—23*b* in FIG. 23*a*.

A modified form is shown in FIGS. 23*a*, 23*b* and comprises a U-shape metal piece that will be on top of piece 120. Its U-shape is shown at 203 and has an opening which will accept piece 123. A hole 204 will allow a nail to go through it and hold the piece 123 securely parked inside it; this nail can be pulled out to let the piece 123 be rotated.

Figure 24:
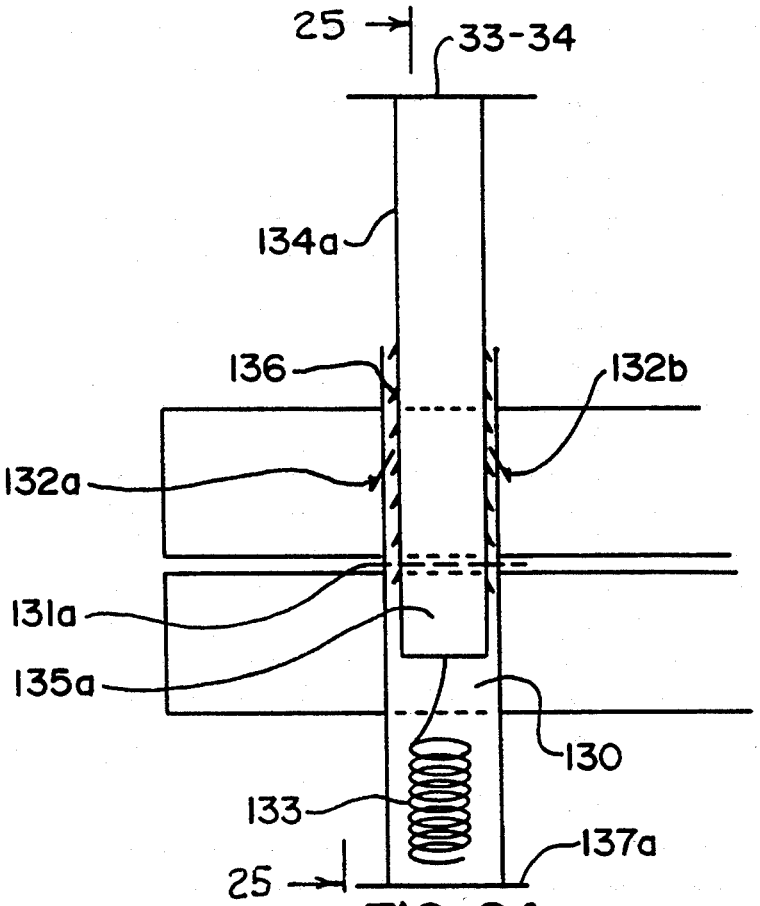
FIG. 24 is a side elevational view of a seventh embodiment on a bed and partly in cross section.

FIG. 24 shows piece 33-34 held in place with use of a pole that is like an aluminum bar 134*a* with a thickness of, for example, 3–5 mm, width of 3 to 5 cm, and length of a couple of feet or so that will slide into a base like a sturdy metal shell 130 that has slightly bigger size than pole 134*a* to allow this pole to move up and down inside it. The base of 130 has a lower end 137*a* and is secured at the sides of the mattresses by straps 131*a* that pull and hold it toward the mattress. The base springs 133 pull the bar 135*a* lower. Multiple spurs 136 with their special shape are made in the sides of the bars 134*a*, 135*a* that will function to hold the bars 134*a*, 135*a* at the right height. Their shape will allow the poles 134*a*, 135*a* to be pulled up but when coming down the tip of brakes 132*a*, 132*b* will prevent the pole from moving down, unless the outside end of the brakes are pressed simultaneously to remove the inside ends away from the spurs. A spring will be connected to each brake to allow its function as described. Then the piece 33-34 will be lowered to sit on the bed. The height of elevation of piece 33-34 can be decided with the level that the pole is pulled up. And a hinge (not shown) in the corner of piece 33-34 and piece 134*a* will allow one end to be elevated somewhat more than the other.

Figure 25:
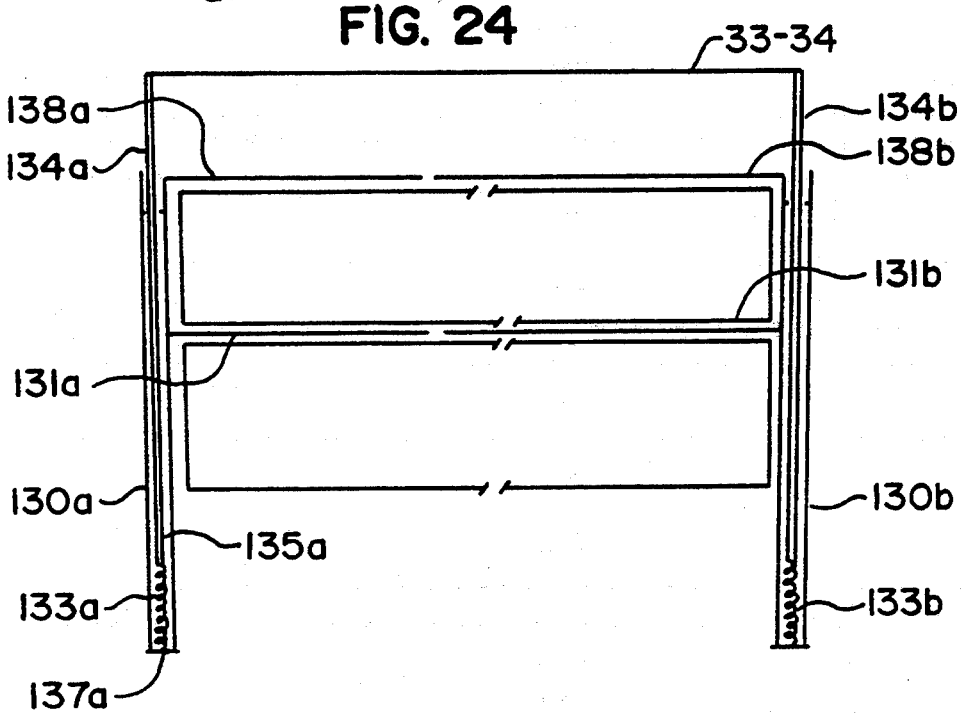
FIG. 25 is a view partly in transverse cross section in the direction of arrows 25—25 in FIG. 24.

FIG. 25 shows base pieces 130*a*, 130*b* and their bottom end pieces 137*a*. A strap that goes between the mattresses to hold the base pieces in place is shown by 131*a* showing the one side of it and 131*b* showing the other side of it. Another strap on top of the upper mattress is shown by 138*a*, 138*b*. The piece 33-34 at the top of the poles 134*a* and 134*b* are illustrated inside the base units 130*a*, 130*b*. The base pieces are held in place with straps 138*a*, 138*b* in the top and 131*a*, 131*b* in the bottom of the upper mattress. The springs 133*a* and 133*b* are also shown.

Figure 26:
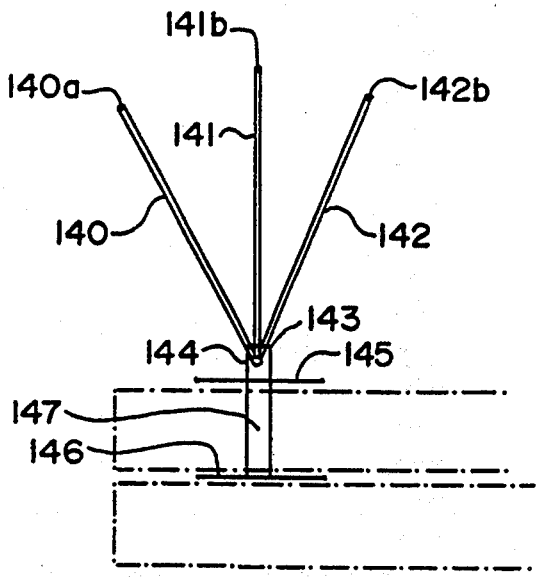
FIG. 26 is a side elevational view of an eighth embodiment.

FIG. 26 shows a toe protector similar to the one shown in FIGS. 21, 22 with slightly different construction. Here again there is a base part that has two upper and lower parts. A lower part 146 sits between the upper and the lower mattresses and an upper part of 145 stands on top to be fixed in that position with tightening on a part 147 of the base piece. The purpose of this base part is to hold the whole unit in place. Then there are three rather thin but strong rods that are shown by 140, 141 and 142 that are all hinged at the point 143 to the upper end of the base unit 144. These rods can rotate all the way down toward the foot end of the mattress but not the head of the mattress due to construction of a part shown in FIG. 28. These rods have a long flat piece shown by their cross cut 140*a*, 141*b* and 142*b*, which will do the job of piece 33-34 to hold the blanket in the air.

Figure 27:
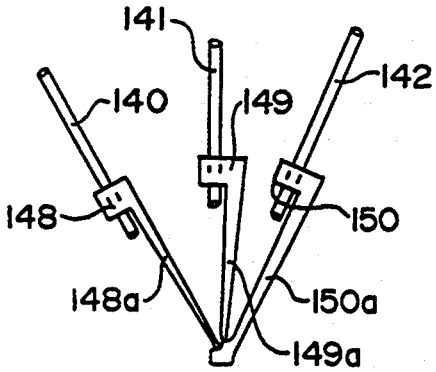
FIG. 27 is a view similar to FIG. 26 showing more detail.

FIG. 27 shows only the part of the hinge and how it holds the rods in place. The lower parts of rods 140, 141 and 142 are held by a respective spring 148, 149 and 150.

Figure 28:
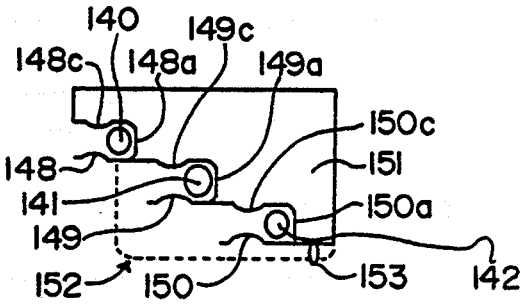
FIG. 28 is a view in the direction of arrows 28—28 in FIG. 27 showing still more detail.

The rods are also standing against a hard parking place 148*a*, 149*a* and 150*a*, better shown in FIG. 28. In FIG. 28 the solid body of the parking places is shown by 151. This part is hard and resistant. This part has places to let the lower parts of rods 140, 141 and 142 stand against hard beds of 148*a*, 149*a* and 150*a*. This prevents the rods from bending toward the head of the bed. From the other side they will be held in place with function of springs 148, 149 and 150 and small matching indentations 148*c*, 149*c* and 150*c* opposite to them on the body of the part 151. A spring 152 connected to the side of the end rod 140 will come to be locked by piece 153 on the body 151 to prevent the rods from moving back toward the foot of the bed. This spring 152 is better shown in FIG. 29.

Figure 29:
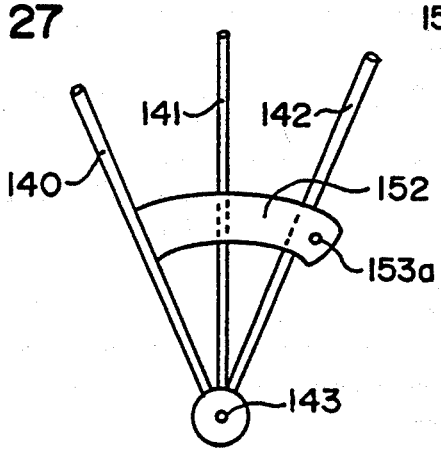
FIG. 29 is a view similar to FIG. 27 illustrating still more detail.

FIG. 29 shows the location of piece 152 in relation to the rods. Piece 152 is a spring attached to the lower end of the rod 140 and it stands in front of the other rods and has an opening 153*a* that will fit piece 153 on body 151 to be held tight in place.

Figure 30:
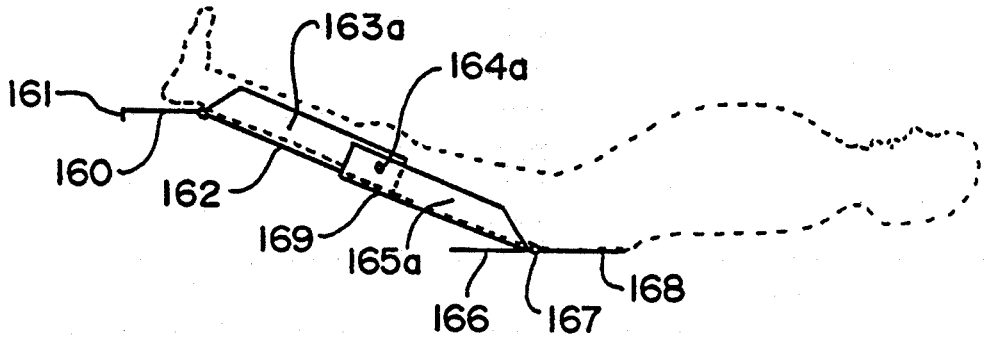
FIG. 30 is a side elevational view of another accessory.

FIG. 30 shows a long cradle, that allows the whole feet of a person to be elevated. In this illustration a person has his whole leg on this cradle. This cradle has three parts (the head part to sit under the hip of the user, the body or middle part to sit under the thigh and knee and legs of the person, and the foot part to sit on the cradle of foot elevator). In this figure the piece 166, 168 is the head piece and sits on the mattress (not shown) under the hip. The hinge 167 allows the long middle part (the middle part consists of two connected parts 162, 169 screwed to each other) to be hinged to piece 166-168. The middle part 162 and 169 has elevated rims to prevent the foot from falling. This rim may be a thin wall only here shown wide. The end of piece 162 is hinged to piece 160 and piece 160 has a rim of 161. In practice the piece 160 will sit on the cradle of the foot elevator. 164*a* is the left side screw which connects the rims of 163*a*, 165*a* of pieces 162 and 169 together.

Figure 31:
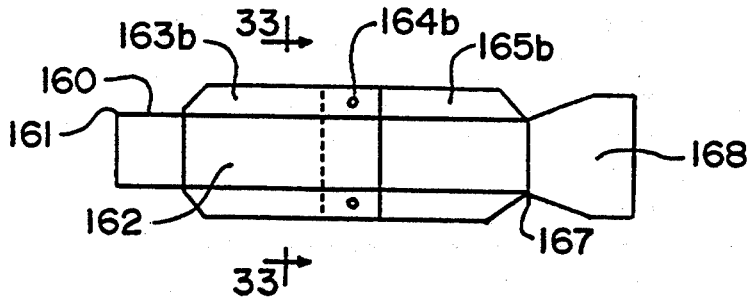
FIG. 31 is a top plan view of FIG. 30.

FIG. 31 shows the right rims of the cradle by 163*b* and 164*b*, the right screw by 164*b*.

Figure 32:
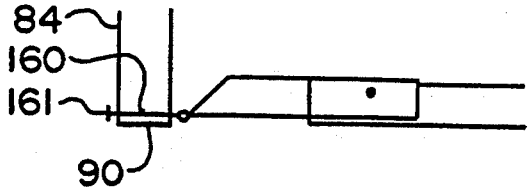
FIG. 32 is a view similar to FIG. 30 showing additional parts.

FIG. 32 shows how the two middle pieces are one over the other and how the piece 160 will stand on the cradle of the foot elevator 90. The rope 84 is also shown.

Figure 33:
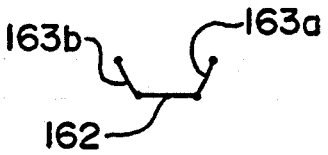
FIG. 33 is a transverse cross section as taken in the direction of arrows 33—33 in FIG. 31.

FIG. 33 is a cross cut of piece 162 showing its base and rims 163*a* and 163*b*. Here again the rims' sizes are exaggerated to give an idea about the shape.

FURTHER DESCRIPTION

This invention is a very useful device: a unit made from metal, mostly aluminum, hard plastic or their combinations and painted nicely or covered with a layer of plastic coating. The base is mounted either temporarily or in some cases permanently (with slight modification) in the lower end of the bed. This unit holds a long flat rectangular surface or bar about a foot or so above the lower end of the bed. The purpose is to hold a blanket on the top of this flat surface or bar and preventing it from touching the toes of a person. This will prevent pressure to the tip of the toes, especially the big toes. I believe this will cause comfort as well as possibly avoiding further deformity of the toes in some cases, where they are already deformed and vulnerable to pressure. This unit is designed so that when it is not being used it can be easily lowered so that the appearance of the bed will be normal or only slightly changed. This is an important point in my mind which not only will give a normal appearance to the bed, but also will allow the person to sit in its edge as he or she wishes.

This basic unit can be even more enjoyable by adding the heating unit that will make the space under the raised blanket comfortably warm. The heating unit has a controller to set the temperature to a desired level, as well as a thermostat to keep the heat at the chosen level. I believe that such goal can be achieved easily and safely when devices such as electric blankets and heating units and pads are already available.

The unit can even be made to hold the feet elevated for medical or personal reasons. This can be done by adding a small mechanical unit alone or combined with the use of the electrical engine that will elevate the feet up with use of the soft cradle is made for this purpose. This will allow the feet or the whole leg to be lifted higher and kept in a level that a person chooses to enjoy comfort or for medical purposes as mentioned.

Because beds are different and people's tastes are different, too, and should be respected, and although I have explained the basic unit that will serve the purpose most of the time, the alternative ways for making this unit have also been mentioned. This is also to show that alternative methods of reaching this basic useful idea are possible with slight modifications of the ideas presented, and should be considered within the scope of the invention.

The unit can be made in larger sizes to hold the blanket higher in the cases when the upper part of the body, the knees, trunk, the chest, etc., should not be pressed by the blanket.

The heater is a part that will make the space under the blanket warm for anyone who may enjoy it, especially people with cold feet. In my experience this will be very enjoyable to most of the people, if not all, to have a bed with a warm area, in winter time. This can be achieved easily with the use of the small built-in heating unit. This heating unit may be placed in either side. However, in this model it is as shown in FIG. 1 and in FIG. 20 to be more secure and protected. The heat source may be chosen to be a regular bulb or a heating bulb. A fuse may be used in either case to further secure the safety.

Another unit for heating the space uses a flat heating pad which will have a size about 1–3 feet or so and in large beds to be longer (with two controllers) to cover the lower width of the bed and to have a soft, washable, exchangeable surface in order not to hurt the heels. This unit will have a hard flat base made from aluminum or hard fire resistant plastic that will be covered by layers of insulator to have the heating wires safely insulated. The part to be covered by a protective screen to protect both the heating elements and the foot from pressure. Then to have the soft cover. The heat level of this unit is adjustable and a thermostat to be incorporated. I believe that making such unit is easily possible considering the progress of the technique.

The elevator will allow the feet or the whole leg for that matter to be kept elevated as long as the person wishes to satisfy the person's feeling or to comply with medical orders. It is known that the elevation of the feet will decrease the swelling of the legs. This unit will help people who like holding their legs up for a period of time to feel better when the swelling decreases. Also, it will be useful in cases when medically the legs should be kept elevated such as phlebitis, ulcerations of the feet and legs and swellings of the legs after certain surgeries as well. The height of the cradle can be adjusted easily with the adjusting the length of the straps that hold the cradle.

I claim:

1. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

wherein said base, when viewed in plan looking vertically downward toward the bed, comprises base members extending lengthwise along respective sides of the bed;

said means forming an enclosure comprising, when viewed in plan looking vertically downward toward the bed, at least one member extending transversely across the bed between, and connecting with, said base members;

and said toe protector further comprising tie-down means, including adjustable, tightenable strap means, extending between said base members for going downward from one of said base members at one side of the bed, then transversely across the bed in underlying relation to a portion of the bed, and then upward to another of the base members at a side of the bed opposite the one side of the bed, said strap means being tightenable to hold said base members on the bed.

2. A toe protector as set forth in claim 1 in which said tie-down means comprises a tightening joint comprising an opening through which a strap passes, the strap making a turn through the opening so that it can be pulled tight and come back against itself, and separable fastening means for separably fastening the strap to itself where it comes back against itself.

3. A toe protector as set forth in claim 2 in which said opening is in one of said base members.

4. A toe protector as set forth in claim 2 in which said opening is in a member of said tie-down means that engages one of said base members by hooking over an edge of said one base member.

5. A toe protector as set forth in claim 2 in which said tie-down means comprises two such tightening joints, one at each side of the bed.

6. A toe protector as set forth in claim 1 in which said second side continues beyond said apex in the direction away from said base.

7. A toe protector as set forth in claim 6 in which a member having a flat horizontal surface for engaging the cover is disposed on said second side beyond said apex relative to said base.

8. A toe protector as set forth in claim 1 in which said third side comprises a hinge joint between said apex and said base to allow said third side to collapse when the toe protector is being collapsed for non-use.

9. A toe protector as set forth in claim 8 in which said second side and said base comprise a further hinge joint between them, and said third side and said base comprise a still further hinge joint between them.

10. A toe protector as set forth in claim 1 in which said second side and said base comprise a hinge joint between them.

11. A toe protector as set forth in claim 10 in which means are provided for adjusting the location along the length of the bed at which said third side engages said base to thereby set the height of said apex above said base.

12. A toe protector as set forth in claim 11 in which a series of notches are provided along said base in the direction of the length of the bed and said third side is selectively engageable with said notches to set the height of said apex above said base.

13. A toe protector as set forth in claim 1 including heater means disposed to generate heat within said enclosure.

14. A toe protector as set forth in claim 1 in which a member having a flat horizontal surface is supported on said enclosure for engaging the cover.

15. A toe protector as set forth in claim 1 in which a member is separably attached to the enclosure at said apex for increasing the area of support for the cover.

16. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

including heater means disposed to generate heat within said enclosure;

in which said heater means comprises an elongate heating element disposed in a member of said base that extends transversely across the bed, and including a reflector disposed behind said heating element to reflect heat into said enclosure.

17. A toe protector as set forth in claim 16 in which said heater means includes a controller for setting a desired temperature and a thermostat for keeping the temperature at the desired level.

18. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

in which a member having a flat horizontal surface is supported on said enclosure for engaging the cover; and in which said member is pivotally supported on said enclosure through a pivot means for pivotally mounting said member on said enclosure, and said member is also supported on said apex by a support means for providing support of said member other than through said pivot means.

19. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

in which said base comprises an upper base portion and a lower base portion, and said upper and lower portions are hingedly connected to allow said upper base portion and said enclosure to be swung out of the way while said lower base portion remains on the bed.

20. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

in which a cradle for the person's feet is suspended from the enclosure for supporting the feet within the enclosure.

21. A toe protector as set forth in claim 20 in which a prime mover is provided for elevating the cradle to a desired elevation within the enclosure.

22. A toe protector as set forth in claim 21 including a control for allowing the person to operate said prime mover to set a desired elevation of the cradle.

23. A toe protector as set forth in claim 20 including a prime mover for setting a desired elevation of the cradle and a controller for operating said prime mover to set a desired elevation of the cradle.

24. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base forming one side of a triangle when viewed from a side of the bed;

means supported on said base forming an enclosure for the person's toes;

said means forming an enclosure for the person's toes comprising, when viewed from the side of the bed, a second side of the triangle and a third side of the triangle;

said second and third sides extending from said base at respective acute angles to said base so as to come together at an apex of the triangle that is over said base;

said means forming an enclosure for the person's toes further comprising means forming an opening for allowing a person to place the toes within the enclosure;

and said means forming an enclosure further comprising means providing for said second and third sides to pivot about said apex, as viewed from the side of the bed;

in which a member is separably attached to the enclosure at said apex for increasing the area of support for the cover; and in which said member is a plate having a step for setting the elevation at which it supports the cover to a level that is different from the elevation of said apex.

25. A toe protector that protects a person's toes from an overlying cover of a bed by supporting such a cover above the person's toes while the person lies on the bed and that can be erected for use and collapsed for non-use, said toe protector comprising:

plural generally U-shaped members that are pivotally mounted on a base that is on the bed for fanning out to form a support for the cover.

26. A toe protector as set forth in claim 25 in which a parking means is provided for parking said U-shaped members in respective parked positions when fanned out.

27. A toe protector that protects a person's toes from an overlying cover of a bed by supporting such a cover above the person's toes while the person lies on the bed and that can be erected for use and collapsed for non-use, said toe protector comprising:

telescoping posts on opposite sides of the bed for vertically raising and lowering a member that engages the cover, said telescoping posts comprising means for urging them to a retracted position that lowers said member, and means for holding the posts in extended positions against the urging of the posts toward retracted position.

28. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed, said base, when viewed in plan looking downward toward the bed, having a U-shape comprising a first portion for extending lengthwise along the foot of the bed, a second portion extending lengthwise from one lengthwise end of said first portion for extending along one side of the bed, and a third portion extending lengthwise from another lengthwise end of said first portion for extending along another side of the bed;

said first, second, and third portions of said base having transverse cross sections that are angled for fitting onto the bed so as to locate said base to the foot and sides of the bed;

means mounted on said base forming an erectable enclosure for a person's toes that provides support for an overlying cover; and tie-down means, including adjustable, tightenable strap means, extending between said second and third portions at a location that is spaced toward the head of the bed from said first portion for going downward from said second portion at one side of the bed, then transversely across the bed in underlying relation to a portion of the bed, and then upward to said third portion at the opposite side of the bed, said strap means being tightenable to hold said second and third portions on the bed.

29. A toe protector as set forth in claim 28 in which said means mounted on said base forming an erectable enclosure comprises an inverted U-shaped member that is pivotally mounted on said base about a pivot axis that extends transversely of the bed proximate said first portion.

30. A toe protector as set forth in claim 28 in which said means mounted on said base forming an erectable enclosure comprises an inverted U-shaped member that is pivotally mounted on said base about a pivot axis that extends transversely of the bed proximate ends of said second and third portions that are opposite said first portion.

31. A toe protector that protects a person's toes from an overlying cover of a bed by supporting such a cover above the person's toes while the person lies on the bed and that can be erected for use and collapsed for non-use, said toe protector comprising:

a generally horizontal base for placement on a bed;

means supported on said base forming an enclosure for the person's toes;

said means forming an enclosure for the person's toes comprising means extending transversely across the bed and vertically above the bed for supporting an overlying cover for the bed;

said means extending transversely across the bed and vertically above the bed comprising first support means providing to one transverse side a greater length of support in the direction of the length of the bed than a second support means that is transversely adjacent said first support means.

32. A toe protector as set forth in claim 31 in which said means extending transversely across the bed and vertically above the bed comprises a first member a portion of which provides said second support means, and a second member that separably mounts on a portion of said first member other than that which provides said second support means to provide said first support means.

33. A toe protector that protects a person's toes from an overlying cover of a bed by supporting such a cover above the person's toes while the person lies on the bed, said toe protector comprising:

a base for placement on a bed, said base having members at opposite sides of the bed;

means supported on said base forming an enclosure for the person's toes, including means for supporting an overlying cover above the toes;

tie-down means, including adjustable, tightenable strap means, extending between said base members for going downward from one of said base members at one side of the bed, then transversely across the bed in underlying relation to a portion of the bed, and then upward to another of the base members at a side of the bed opposite the one side of the bed, said strap means being tightenable to hold said base members on the bed.

* * * * *